US006289266B1

(12) United States Patent
Payson et al.

(10) Patent No.: US 6,289,266 B1
(45) Date of Patent: Sep. 11, 2001

(54) METHOD OF OPERATING A BOILER

(75) Inventors: Edward P. Payson, Uniontown; Daniel V. Sendro, Greensburg, both of PA (US)

(73) Assignee: Allegheny Power Service Corporation, Greensburg, PA (US)

( * ) Notice: Subject to any disclaimer, the term of this patent is extended or adjusted under 35 U.S.C. 154(b) by 0 days.

(21) Appl. No.: 09/312,363

(22) Filed: May 14, 1999

(51) Int. Cl.[7] ..... G05B 13/02; G05B 21/00

(52) U.S. Cl. ..... 700/274; 31/50; 31/282; 110/191; 110/347

(58) Field of Search ..... 700/82, 274, 29–31, 700/50, 282; 110/345, 347, 261, 234, 191; 702/24, 136

(56) References Cited

U.S. PATENT DOCUMENTS

| | | | | |
|---|---|---|---|---|
| 4,362,269 | * | 12/1982 | Rastogi et al. | 236/14 |
| 4,613,952 | * | 9/1986 | McClanahan | 364/578 |
| 5,231,939 | * | 8/1993 | Tanaka et al. | 110/347 |
| 5,611,494 | * | 3/1997 | Williams | 241/27 |
| 5,630,368 | * | 5/1997 | Wagoner et al. | 110/234 |
| 5,694,869 | * | 12/1997 | Breen et al. | 110/345 |
| 5,724,897 | * | 3/1998 | Breen et al. | 110/261 |
| 5,764,535 | * | 6/1998 | Okazaki et al. | 702/24 |
| 5,764,544 | * | 6/1998 | Sheldon | 702/24 |
| 6,030,204 | * | 2/2000 | Breen et al. | 431/4 |

OTHER PUBLICATIONS

E Ultramax (The Ultramax Method of Dynamic Optimization).

WDPFII System Overview (Descriptive Bulletin 21–161).

* cited by examiner

*Primary Examiner*—Paul P. Gordon

(74) *Attorney, Agent, or Firm*—Arnold B. Silverman; David C. Jenkins; Eckert Seamans Cherin & Mellott, LLC

(57) ABSTRACT

A method of controlling operation of a particulate fuel burning boiler, such as a coal fired boiler, having a plurality of burners each receiving pulverized coal, primary air and secondary air. The flow rate of the pulverized coal, primary air and secondary air is determined independently for each burner and is compared with a model. In the event that the comparison results in a determination that one or more of the flow rates depart from the desired rate by a predetermined amount, a control signal is emitted to adjust the air to flow ratio entering the specific burner. The control signal which alters the air to fuel ratio may result in alteration of the air or fuel flow rates. The method may be employed to reduce $NO_x$ emissions, loss on ignition and to optimize heat rate.

29 Claims, 3 Drawing Sheets

METHOD OF OPERATING A BOILER

BACKGROUND OF THE INVENTION

1. Field of the Invention

The present invention relates to methods of operation of boilers and, more specifically, is directed toward the optimization of operation of coal fired boilers through monitoring and adjustment of fuel and air supplied to individual burners.

2. Description of the Prior Art

It has long been recognized that in connection with numerous industrial activities, including utility power plants that public policy dictates that attention be directed toward the impact such activities have on the environment, both near term and long term. In the United States, under both federal law and state laws, as well as related regulations and judicial interpretations, large bodies of legal requirements have evolved.

Within the limits imposed by environmental considerations, there is a strong desire to lower production costs by enhancing boiler efficiency. For example, in fossil burning electric utility plants, there is a need to provide for improvement and performance of coal fired boilers.

It has been known to employ optimization software in an effort to control the operation of coal fired boilers remaining at stable load conditions with a view toward enhanced efficiency of performance and comply with environmental requirements.

In spite of the foregoing, there remains a very real and substantial need for improved systems for controlling operation of boilers with focus upon monitoring and controlling the performance of individual burners responsive to load conditions to reduce production costs while complying with environmental requirements.

SUMMARY OF THE INVENTION

The present invention has met the above described need by providing a boiler having a plurality of burners each being monitored in respect of fuel flow and air flow. This information is delivered to and processed by a computer, which may be a microprocessor, which compares the flow rates with a stored model for the boiler and if a predetermined difference exists as to a particular burner, between the data determination and the model an adjustment is made in the air to fuel ratio for that burner. This adjustment may, for example, be made by altering the secondary air flow or the fuel flow.

The method involves monitoring each boiler burner separately and making determinations for controlling the same separately. The method may be employed to minimize $NO_x$ emissions, minimize loss on ignition and to optimize heat rate.

In a preferred embodiment of the invention pulverized coal is delivered to a burner in a conduit with the primary air serving to transport the coal. The flow rates of the pulverized coal is determined within this conduit and the secondary air flow is determined by separate means. The primary air flow may be determined from the measured fuel flow and secondary air flow or may be measured.

Repeated cycles of monitoring and control of the individual burners with model updates being provided as changes are made in the flow rates all contribute to accomplishing the objectives of the present invention.

It is an object of the present invention to provide a method for enhanced automated control of a boiler which on a burner by burner basis enhances boiler efficiency.

It is a further object of the present invention to provide such a method wherein computerized control permits rapid determinations of the flow conditions to a boiler burner and issuance of control signals where appropriate along with updating of the computer model.

It is another object of the present invention to provide a method of operating a coal fired boiler which will reduce $NO_x$ emissions.

It is a further object of the present invention to improve efficiency of operation of fossil fuel boilers employed by electricity generating utilities, as well as in other industrial uses.

It is a further object of the present invention to provide such a method which will operate more efficiently under conditions of varying boiler load.

It is another object of the present invention to provide such a method which monitors and controls individual burners.

It is a further object of the present invention to provide such a system which is adapted to control operation of a boiler in the load following mode.

These and other objects of the invention will be more fully understood from the following description of the invention on reference to the illustrations appended hereto.

DESCRIPTION OF THE PREFERRED EMBODIMENTS

As employed herein, the term "pulverized coal" means coal having an average size range generally employed in industrial boilers including electric utility boilers and shall expressly include pulverized coal having an average particle size of about 200 to 50 mesh.

The term "heat rate" means the "heat rate," as employed in the utility industry, and refers to the pounds of fuel consumed multiplied by the heating value of the fuel which yields a numerator in BTU. This is divided by the net output of the generator in kilowatt/hours of electricity.

The term "load following mode" means that the boiler output will vary with time and the method must, in effecting optimization, follow such changes in load in order to operate efficiently.

The terms "computers" or "microprocessor" mean generally any system or component of a system which through software, firm ware, hardware, and combinations thereof function to receive, store and process information and output results of such activities.

As employed herein, the term "boiler" means a fossil fueled industrial capacity boiler having a plurality of burners.

Figure 1:
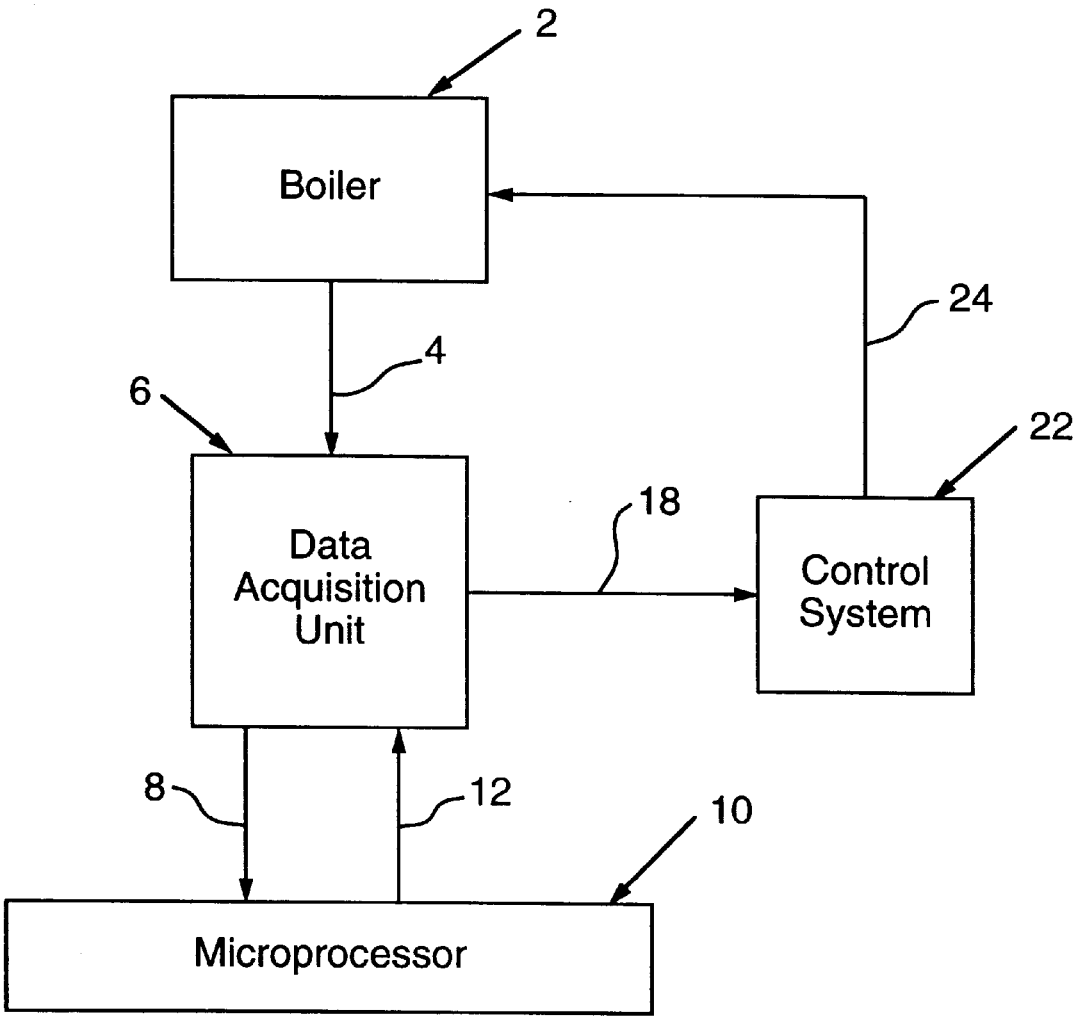
FIG. 1 is a schematic illustration of a general arrangement usable in the methods of the present invention.

Referring to FIG. 1, there is shown a boiler 2 which has a plurality of burners which in the practice of the methods of the present invention will be independently monitored and controlled in an improved manner to achieve the purposes of the invention. Each boiler burner will have a coal pipe or conduit through which pulverized coal will be transported by the primary air flow to the burner. In addition, secondary air will be delivered to the burner. This results in a target air to fuel mixture designed for efficient operation of the boiler burner.

Appropriate sensor means for monitoring flow of the coal, the primary air and secondary air, provide through path 4 to data acquisition unit 6. The primary air may be determined from the fuel flow and secondary air flow. It is known that about 10.5 pounds of air is needed to burn 1 pound of coal at about 450° F. to 550° F. In the alternative, the primary air flow may be measured. In general, the primary air flow will be about 15 to 20 percent of the total combustion air, i.e., the primary air flow plus the secondary air flow. As employed herein, the term "determining the primary air flow" shall include calculation of the flow rate as well as measurement.

The data acquisition unit 6 delivers the data through path 8 to microprocessor 10. The microprocessor 10 has or creates a model for the entire system in respect of the flow characteristics. When as to a particular burner the flow measurements depart from the model flow values by a predetermined amount, a control signal is emitted over path 12 by microprocessor 10 to data acquisition unit 6 which in turn responsively emits over path 18 a control signal to control system 22. Control system 22 emits a control system over path 24 to the boiler 2 to effect the desired change in the air to fuel ratio of the particular burner. Changes in the air to fuel ratio may be effected by changing the secondary air flow. If desired, the primary air flow or fuel flow or combination of changes of the two air flows and fuel flow may be employed.

The system model is also preferably altered responsive to the information received from each burner. These system model revisions are preferably made sequentially as each burner is controlled as contrasted with model revision only after all of the burners have been monitored and adjusted.

By sequential rapid monitoring of each burner and emitting appropriate control signals to adjust the air to fuel ratio, the boiler may be operated while optimizing $NO_x$ emissions, reducing loss on ignition and effectively controlling the heat rate even under varying load conditions. The present method may also be employed to monitor and control other conditions, such as $O_2$ and damper position, for example.

The burners may be scanned at a rate of about one second for a scan of all of the burners, for example.

As to each burner, the total system model will be revised based on the parameters monitored and control signals issued for the specific burner such that the next burner monitored will be based upon the then current model.

In general, the boiler 2 will have a plurality of burners which generally will involve at least 4 to 6 burners with the minimum fuel flow to maximum fuel flow percentage being about 15 to 65 percent.

Figure 2:
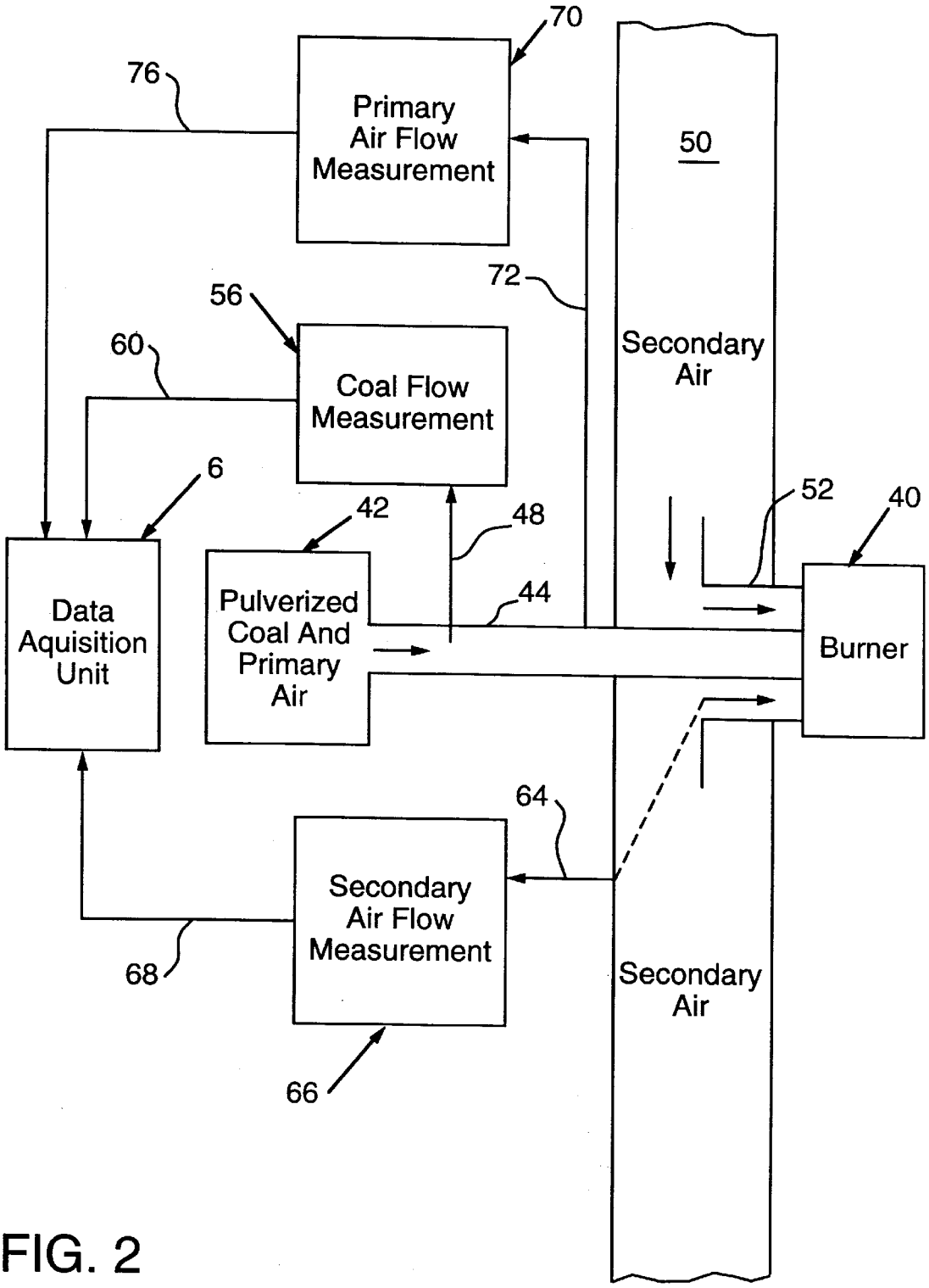
FIG. 2 is a schematic illustration showing details of a preferred version of the method of the present invention employed with a single burner.

Referring to FIG. 2, there is shown a burner 40 which is representative of one of the plurality of burners which will be present in the boiler. Pulverized coal and primary air are delivered by unit 42 through conduit 44 to burner 40. Secondary air is delivered through wind box 50 through annular conduit 52 which surrounds conduit 44. The volume of flow of the pulverized coal, primary air and secondary air establishes the air/fuel mixture which enters the burner and sustains the flame burning therein with the air, once heated, emerging through a conventional boiler structure. A coal flow sensor 56 monitors the rate of flow of the pulverized coal in conduit 44 receives data through path 48 and delivers this data through path 60 to data acquisition unit 6. This may be accomplished by known means such as known microwave absorption means or electrostatic means which monitors particle charge or through ultrasonic means, for example. There are also means available to measure the coal particulate velocity and mass flow in conduit 44 through path 48 to sensor 56 and deliver that information by path 60 to the data acquisition unit 6. Primary air flow in conduit 44 may be determined as described herein or measured by primary air flow measurement means 70 from data received over path 72 with output going to data acquisition unit over path 76. Similarly, the secondary air flow is sensed through means 66 which receives information over path 64 from adjacent burner 40 in conduit 52 and delivers the information to the data acquisition unit 6 through path 68.

In this manner, the data acquisition unit 6 receives information regarding fuel flow, primary air flow and secondary air and, in turn, as discussed in connection with FIG. 1, provides this information to microprocessor 10.

Figure 3:
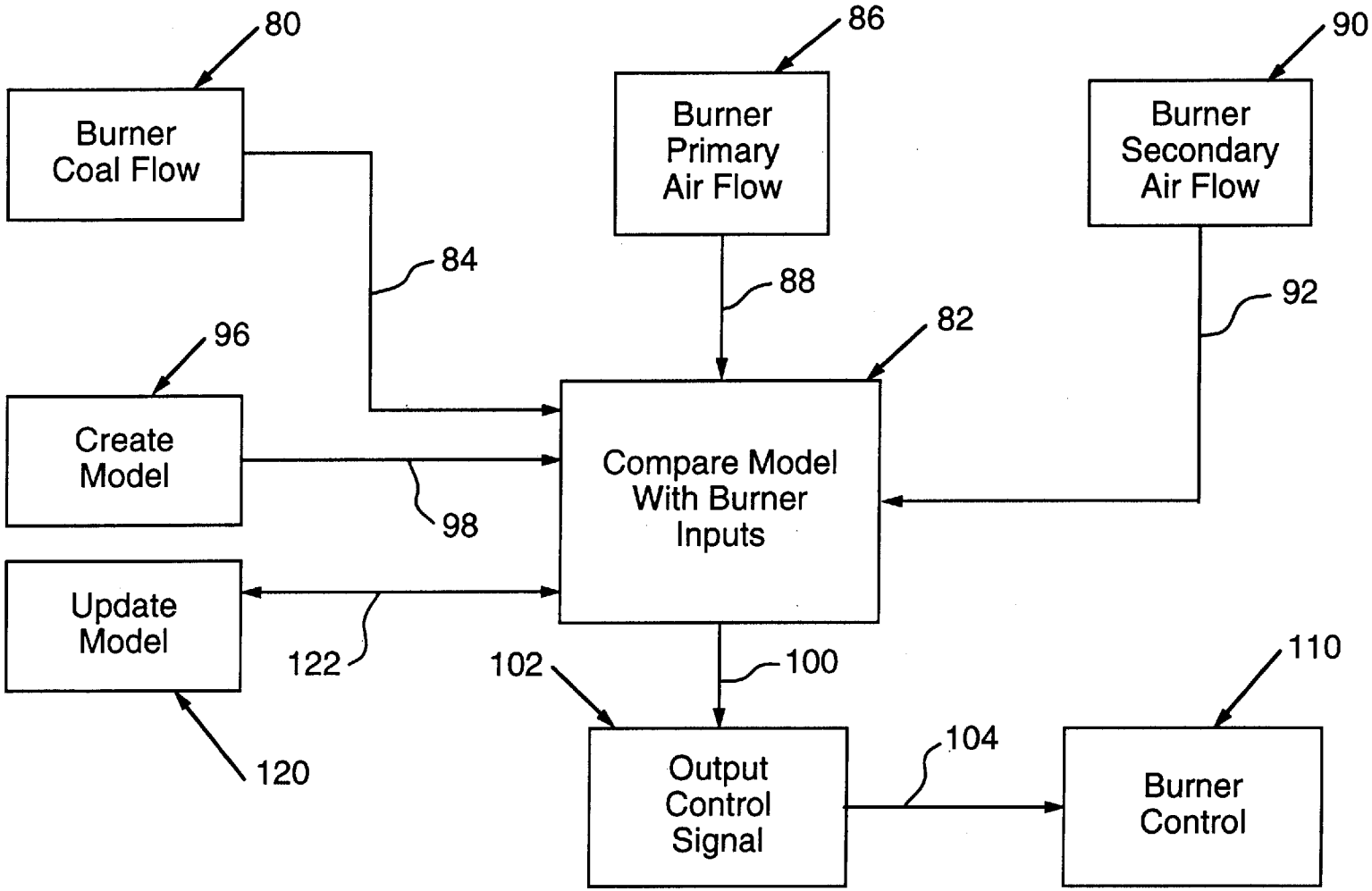
FIG. 3 is a schematic diagram showing a sequence of operation of the present invention.

Referring to FIG. 3, there is shown a sequence of operation wherein burner coal flow rate 80 will be delivered to a portion of the microprocessor 82 over path 84. Burner primary air flow rate 86 (either computed or measured) will be delivered over path 88 to microprocessor portion 82 and burner secondary air flow rate 90 will be delivered over path 92 to portion 82 of the microprocessor. The model creation 96 may involve a model created and delivered over path 98 prior to performance of the method or one created thereafter either as an initial model or an update. When the microprocessor segment 82 compares the input from flow sensing units 80, 86, 90 and compares it with the model, it emits an output signal over path 100 to output control signal unit 102 if the difference between the model and the actual flow measurements reaches a predetermined level. The output control signal unit 102 then issues a signal over path 104 to burner control unit 110 to cause the particular burner unit to have a modified air/fuel ratio. One preferred way of accomplishing this is to adjust the rate of flow of the secondary air thereby altering the numerator of the air/fuel ratio. Alternate ways would be to alter the fuel flow rate or the primary air flow rate or through a change in two or more of the monitored flow rates. All of this is accomplished in a real time context so that actual flow rates are being employed. Depending upon the particular computer system adopted, the approach may be based on a neural network or a Bayesian network or fuzzy logic, for example.

The information regarding a specific burner which is employed to create the output signal emitted by microprocessor segment 82 is also delivered to update model unit 120 by path 122 which responsively updates the model for the entire system and delivers the updated model to microprocessor segment 82 over lead 122.

It will be appreciated in this manner with the benefits of the speed of operation of the microprocessor and the ability to through multiplexing scan each burner sequentially on the order of about once per second ongoing alteration of the air to fuel ratio custom tailored to each burner may be effected despite load changes in the boiler. All of this results in desired reduction in $NO_x$ emission, reduction on loss on ignition and efficient optimized control of the heat rate.

The boiler may typically have incoming air emerging at a temperature of about 500° F. to 715° F.

Among the software which may be adapted for use in the present invention efficiently is that sold under the trade designation "Ultramax Dynamic Optimization Software" by Ultramax Corporation of Cincinnati, Ohio. A suitable boiler is that sold by Foster Wheeler opposed-wall coal-fired boiler equipped with its IFS Low NOX burners and capacity rating of 180 MW.

A suitable control and data acquisition system is that marketed by Westinghouse under the designation WDPF Distributed Control System. Other suitable control and data acquisition systems are the Infi 90 available from Bailey Controls and products of Honeywell and Foxboro.

It will be appreciated, therefore, that the present invention provides effective methods, on a burner by burner basis, for achieving enhanced levels of performance, and with the benefits of computerized evaluation, modeling, processing, and control signals, as well as responsive changes in flow rates providing the desired air to fuel ratio to enhance performance of the boiler from both an environmental and efficiency perspective.

While for simplicity of disclosure some emphasis has been placed upon coal fired boilers usable in electricity generating plants, the invention is not so limited and the methods may be employed in boilers used in many other types of industries such as, for example, petrochemical, pulp and paper, general manufacturing, as well as other industries.

While for convenience of disclosure reference has been made to the use of coal as the solid fuel, the invention may also be employed with other particulate fuels usable in industrial boilers.

Whereas particular embodiments of the invention have been described herein for purposes of illustration, it will be evident to those skilled in the art that numerous variations of the details may be made without departing from the invention as defined in the appended claims.

What is claimed is:

1. A method of controlling operation of a boiler comprising providing a boiler having a plurality of burners each receiving particulate solid fuel primary air and secondary air, determining as to each of a plurality of said burners the flow of said fuel, the flow of said primary air and the flow of said secondary air, comparing said flow determinations with respect to each said burner with a model of desired flow, and if a predetermined difference exists between said flow determinations and said model altering at least one of said flow rates to achieve a desired air to fuel ratio in said burner.

2. The method of claim 1 including employing pulverized coal as said particulate solid fuel.

3. The method of claim 2 including employing said method on each said burner individually.

4. The method of claim 3 including achieving the desired air to fuel ratio by altering said secondary air flow.

5. The method of claim 4 including employing a microprocessor to effect said comparisons and emit a responsive control signal when said flow alteration is to be effected.

6. The method of claim 5 including employing said method to minimize $NO_x$ emission.

7. The method of claim 5 including employing said method to minimize loss on ignition.

8. The method of claim 5 including employing said method to optimize boiler heat rate.

9. The method of claim 3 including determining said coal flow and said primary air flow in conduits delivering said coal and said primary air to each said burner.

10. The method of claim 9 including effecting said determination of said primary air flow by calculations based on said coal flow and said secondary air flow.

11. The method of claim 3 including after effecting a change in the air to fuel ratio on a said burner updating said model.

12. The method of claim 10 including repeating said method at a predetermined frequency.

13. The method of claim 10 including employing a single said model for said model, and effecting a change in said model after each change in the air to fuel ratio of a said burner.

14. The method of claim 3 including achieving the desired air to fuel ratio by altering said fuel flow.

15. The method of claim 2 further including the step of combining said pulverized coal and said primary air in a single conduit prior to determining said coal flow rate.

16. A method of controlling operation of a particulate solid fuel fired boiler having a plurality of burners comprising monitoring as to each said burner fuel flow, primary air flow, and secondary air flow, and employing a microprocessor to compare said monitored flows with a model and in the event the flow rates depart from said model by a predetermined amount altering said air to fuel ratio for said burners.

17. The method of claim 16 including employing pulverized coal as said particulate solid fuel.

18. The method of claim 17 including periodically updating said model based upon said monitored flow rates.

19. The method of claim 18 including employing said method with varying boiler load ranges.

20. The method of claim 19 including employing said method with a boiler having at least 9 said burners.

21. The method of claim 18 including employing a single said model for said model, and effecting a change in said model after each change in the air to fuel ratio of a said burner.

22. The method of claim 16 including achieving the desired air to fuel ratio by altering said secondary air flow.

23. The method of claim 22 including employing said method to minimize $NO_x$ emissions.

24. The method of claim 22 including employing said method to minimize loss on ignition.

25. The method of claim 22 including employing said method to optimize boiler heat rate.

26. The method of claim 16 including employing real time measurement of said flow rates.

27. The method of claim 16 including determining said coal flow and said primary air flow in conduits delivering said coal and said primary air to each said burner.

28. The method of claim 27 including effecting said determination of said primary air flow by calculations based on said coal flow and said secondary air flow.

29. The method of claim 16 including achieving the desired air to fuel ratio by altering said fuel flow.

* * * * *

UNITED STATES PATENT AND TRADEMARK OFFICE

CERTIFICATE OF CORRECTION

PATENT NO. : 6,289,266 B1
DATED : September 11, 2001
INVENTOR(S) : Edward P. Payson et al.

It is certified that error appears in the above-identified patent and that said Letters Patent is hereby corrected as shown below:

Title page,
ABSTRACT,
Line 9, "air to flow" should read -- air to fuel --.

Column 4,
Line 59, delete "emerging".
Line 66, "NOX" should read -- $No_x$ --.

Column 6,
Lines 25, 29, 50, 52 and 54, start new paragraph with "employing".
Line 56, start new paragraph with "determining".

Signed and Sealed this

Seventeenth Day of September, 2002

*Attest:*

*Attesting Officer*

JAMES E. ROGAN
*Director of the United States Patent and Trademark Office*